United States Patent [19]

Hyatt

[11] Patent Number: 4,524,349

[45] Date of Patent: Jun. 18, 1985

[54] SECURITY SYSTEM HAVING DETECTOR SENSING AND IDENTIFICATION

[75] Inventor: David R. Hyatt, Portland, Oreg.

[73] Assignee: Nel-Tech Development, Inc., Portland, Oreg.

[21] Appl. No.: 406,492

[22] Filed: Aug. 9, 1982

[51] Int. Cl.[3] ..... G08B 29/00

[52] U.S. Cl. ..... 340/500; 340/506; 340/508; 340/510; 340/511

[58] Field of Search ..... 340/500, 510, 511, 508, 340/501, 506, 825.05, 870.13, 870.09, 870.16, 870.21

[56] References Cited

U.S. PATENT DOCUMENTS

| | | | |
|---|---|---|---|
| 3,370,181 | 2/1968 | Sitomer | 307/247 |
| 3,588,865 | 6/1971 | Hansen | 340/276 |
| 3,626,403 | 12/1971 | Ive | 340/276 |
| 3,964,302 | 6/1976 | Gordon et al. | 73/117.3 |
| 4,118,700 | 10/1978 | Lenihan | 340/524 |
| 4,146,750 | 3/1979 | Spiesman | 340/870.13 |
| 4,198,625 | 4/1980 | Mande et al. | 340/506 |
| 4,283,717 | 8/1981 | Caldwell et al. | 340/511 |
| 4,310,835 | 1/1982 | Sefton | 340/533 |
| 4,339,746 | 7/1982 | Ulicki et al. | 340/506 |
| 4,359,721 | 11/1982 | Galvin et al. | 340/511 |
| 4,414,539 | 11/1983 | Armer | 340/511 |

OTHER PUBLICATIONS

2 Nel-Tech Development, Inc. Prototype Circuit Drawings, Exhibits A and B, sent to Westec Security Systems, Jun. 1980.

2 Nel-Tech Development, Inc. Prototype Circuit Drawings, Exhibits C and D, showing security system built and sent to Westec Systems for experimental testing prior to Aug. 9, 1981.

*Primary Examiner*—Donnie L. Crosland

*Attorney, Agent, or Firm*—Klarquist, Sparkman, Campbell, Leigh & Whinston

[57] ABSTRACT

A security system including a plurality of sensor loops, each having a plurality of detectors and associated detector identification devices which upon actuation produce analog detector signals of different amplitude for each detector in such loop to identify the actuated detector. The sensor loops each have a common loop output which is connected to a different one of a plurality of input terminals of an analog to digital converter and multiplexer circuit which includes a multiplexer switching circuit for selectively switching between such inputs and which converts the selected analog detector signal to a digital detector output signal. The outputs of the analog to digital converter are connected to a digital data processor circuit, such as a microprocessor computer, for processing the digital detector signals to determine which detector produced such signals and to generate a corresponding output signal that may operate an alarm means such as a bell or indicator light. The sensor loops each include a plurality of detectors which may be detector switches that are connected in series or in parallel sensor circuits, such sensor circuits each including an identification device for identifying its associated detector when such detector is actuated. The identification devices can be resistors each of a different value for its associated detector, or it can be constant current sources or constant voltage sources of different values.

17 Claims, 5 Drawing Figures

A/D CONVERTER
START CLOCK
168
166
155

164
170
CONTROL AND TIMING
END OF CONVERSION (INTERRUPT)
152
154
182
16 CHANNELS MULTIPLEXING ANALOG SWITCHES
LOOP INPUTS
26
SUCCESSIVE APPROXIMATION REGISTER
COMPARATOR
158
TRI STATE OUTPUT LATCH BUFFER
42
8 BIT OUTPUTS
150
174
172
156
SWITCH TREE
4 BIT ADDRESS
ADDRESS LATCH AND DECODER
160
162
176
256R RESISTOR LADDER
178
180
EXPANSION CONTROL
34
REF+
REF−
OUTPUT ENABLE
ADDRESS LATCH ENABLE
62
V+
V−

SECURITY SYSTEM HAVING DETECTOR SENSING AND IDENTIFICATION

BACKGROUND OF INVENTION

The subject matter of the present invention relates generally to security systems having a large number of detectors for detecting different conditions such as smoke, fire or intrusion of unauthorized persons. They may include switch-type detectors for sensing window breakage, door opening, window opening, floor mat sensors, sound detectors and radiant energy type detectors, including those using infrared, ultrasonics, microwaves or visible light. In a typical complex security installation a building will be provided with twenty such detectors per floor. In order to reduce system cost and circuit complexity, a plurality of sensor loops are employed, each loop including a plurality of detectors and associated identification means for identifying which detector in the loop has been actuated by producing analog detection signals of different amplitudes for each detector.

In U.S. Pat. No. 4,310,835 of Sefton issued Jan. 12, 1982, a security system is disclosed having sensor loops which each include a plurality of detectors connected in series. The detectors in the sensor loop are each connected in parallel with resistors of equal value which indicate the actuation of a detector by a change in the resistance of the sensor loop but do not identify the actuated detector. Thus, the outputs of the sensor loops are connected to a central control circuit containing a monostable circuit formed by a pair of NOR gates which is triggered by the detector signal to detect changes in resistance of the sensor loop due to the actuation of one of the detector switches. However, since the resistances in parallel with the detector switches are of the same resistance value, there is no way of identifying which detector is actuated so that security personnel cannot know whether to respond immediately or how to respond without viewing the detector. For example, if one of the detectors in the loop was a fire detector while another detector was an open door switch, there would be no way of knowing whether there was a fire or the door had been inadvertently left open.

The security system of the present invention overcomes this problem by providing an identification means for the detectors in the sensor loop including a separate identification means for each of the detectors to identify the actuated detector by changes in the amplitude of the analog detector signal produced by such loop. This type of analog signal identification means is much simplier and less expensive than that used by prior systems employing digital coded identification signals which have previously been employed to identify different detectors by sending such digital coded identification signals over the same line as the detector signal, but at a different time.

It has been suggested previously in U.S. Pat. No. 4,118,700 of Lenihan issued Oct. 3, 1978 to provide a security system including a single sensor loop having a plurality of detectors connected in series, such detectors being connected in parallel with resistors of different value in order to identify the detectors actuated by changes in the amplitude of the analog detection signal similar to the present invention. However, the analog signal output of the sensor loop is connected to one input of five voltage comparators, each having their other inputs connected to different D.C. reference voltages. The comparators are switching circuits having their outputs connected through NAND gates to provide an analog to digital converter having a digital detection signal output. This analog to digital converter having a single analog input and a plurality of comparators, is much more complicated and has many more circuit components than the security system of the present invention. The security system of the present innvention is of reduced complexity and greater flexibility due to employing an analog to digital con- verter and multiplexer circuit having a plurality of inputs which are connected to a plurality of different sensor loops. The multiplexer selectively switches between such inputs and applies them to the same comparator at different times to convert the analog detector signal of the selected loop to a digital detector output signal.

Also, the outputs of the analog to digital converter in the present security system are connected to a digital data processing circuit, such as a microprocessor computer, which processes the digital detector signals to determine which actuated detector in the loop generated such signals and actuates an appropriate alarm such as a bell or light indicator. The digital data processor controls the operation of the multiplexer and the analog to digital converter. One suitable analog to digital converter and multiplexer circuit has sixteen inputs which may be connected to sixteen sensor loops, each loop having four or more detecors so that the security system is capable of sensing sixty-four or more detectors. None of the prior security systems use such a multiplexer and analog to digital converter controlled by a digital data processor or microprocessor computer.

Further, the security system of the present invention differs from such prior systems by employing sensor loops having detectors connected in parallel sensor circuits. As a result, such detectors may be more easily connected to the loop by "insulation displacement" connections which penetrate through the insulating coating on the loop wire to form an electrical connection mechanically without stripping the insulation from such wire. Thus, the parallel connection of the detectors enables such detectors to be more easily and quickly installed. Also, such connections are more reliable and do not break as easily as those formed by twisted wires or soldering.

Additional flexibility results in the present security system by using a microprocessor computer to control the analog to digital converter because of the ability to change the computer program of the microprocessor by means of a keyboard directly connected thereto or by a central station having a remote keyboard and display connected by phone lines thereto. As a result, faulty detectors can be ignored or entire sensor loops deactivated without rewiring by changing the computer program, or the program may be modified to accommodate additional sensor loops or additional detectors. No such flexibility is possible in the previous security systems because none of them employ a microprocessor computer or other similar digital data processing circuitry.

SUMMARY OF INVENTION

It is therefore one object of the present invention to provide an improved security system of reduced complexity and increased flexibility having a large number of detectors, which when actuated, are identified by differences in the amplitude of the analog detection signals produced thereby.

Another object of the invention is to provide such a security system which is capable of sensing the detectors in an efficient and inexpensive manner by employing a large number of sensor loops each employing a plurality of detectors having their loop outputs connected to an analog to digital converter through a multiplexer for selectively switching between such outputs to convert the analog detector signals into digital detector signals.

A further object of the invention is to provide such security system employing a digital data processor circuit for controlling such multiplexer and such analog to digital converter, for processing the digital detector signals produced by the analog to digital converter to determine which detector produced the detector signal and for generating corresponding output signals which may be employed to actuate alarms.

An additional object of the invention is to provide such a security system of greater flexibility in which the data processor is a microprocessor computer and the computer program of such microprocessor may be changed by a keyboard directly connected thereto or at a remote central station connected thereto over a telephone line in order to make changes in the system without rewiring.

Still another object of the present invetion is to provide such a security system which identifies the actuated detector and operates an associated alarm in a simple, accurate and efficient manner by a separate identification means associated with each detector.

A still further object of the invention is to provide such a security system of greater versatility and lower cost which can employ a plurality of different types of sensor loops and identification means including loops having detectors connected in series sensing circuits and those having detectors connected in parallel sensing circuits.

Still another object of the invention is to provide such an improved security system employing sensor loops having detectors connected in parallel sensing circuits which enables easier connection of the detectors to the sensor loops for replacing, adding or subtracting detectors and which enables stronger more reliable detector connections of the insulation displacement type.

DESCRIPTION OF DRAWINGS

Other objects and advantages of the present invention will be apparent from the following description of preferred embodiments thereof, and from the attached drawings of which.

DESCRIPTION OF PREFERRED EMBODIMENTS

Figure 1:
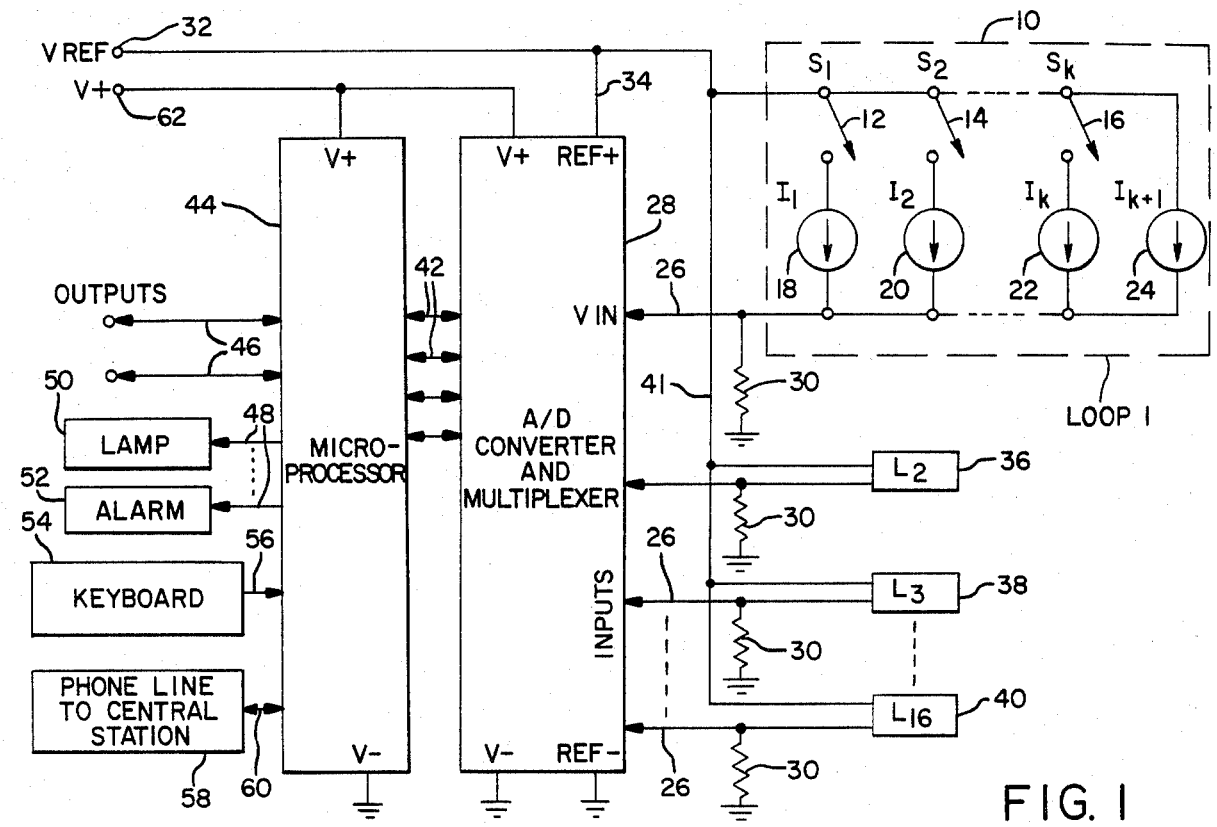
FIG. 1 is a schematic diagram of the electrical circuit of a security system in accordance with one embodiment of the invention including sensor loops having detectors connected in parallel sensor circuits with constant current sources of different current values as the identification means associated with each detector to identify the actuated detector.

As shown in FIG. 1, one embodimment of the security system of the present invention includes a first sensor loop 10 containing a plurality of detectors 12, 14 and 16 which are connected in parallel sensor circuits. Each sensor circuit includes a detector identification means, such as one of a plurality of constant current sources 18, 20 and 22 of different current outputs, connected in series with its associated detector. The current sources may be insulated gate field effect transistor circuits. Thus, the first detector 12 represented by a normally open detector switch $S_1$ is connected in series with the first current source 18 producing a first D.C. current $I_1$ of a given amplitude. The second detector 14 shown by normally open detector switch $S_2$ is connected in series with the second constant current source 20 which produces a D.C. current $I_2$ of greater amplitude than current $I_1$. The third detector 16 represented by a normally open detector switch $S_k$ is connected in series with a third constant current source 22 producing a D.C. current $I_k$ which is greater than current $I_2$ or current $I_1$. A fourth constant current source 24 producing a D.C. current $I_{k+1}$ is connected in parallel with all of the detectors 12, 14 and 16 and their associated current sources 18, 20 and 22, such fourth current $I_{k+1}$ being of greater amplitude than currents $I_k$, $I_2$ and $I_1$. For example, $I_1=1$ milliamp, $I_2=2$ milliamps, $I_k=4$ milliamps and $I_{k+1}=8$ milliamps.

Figure 5:
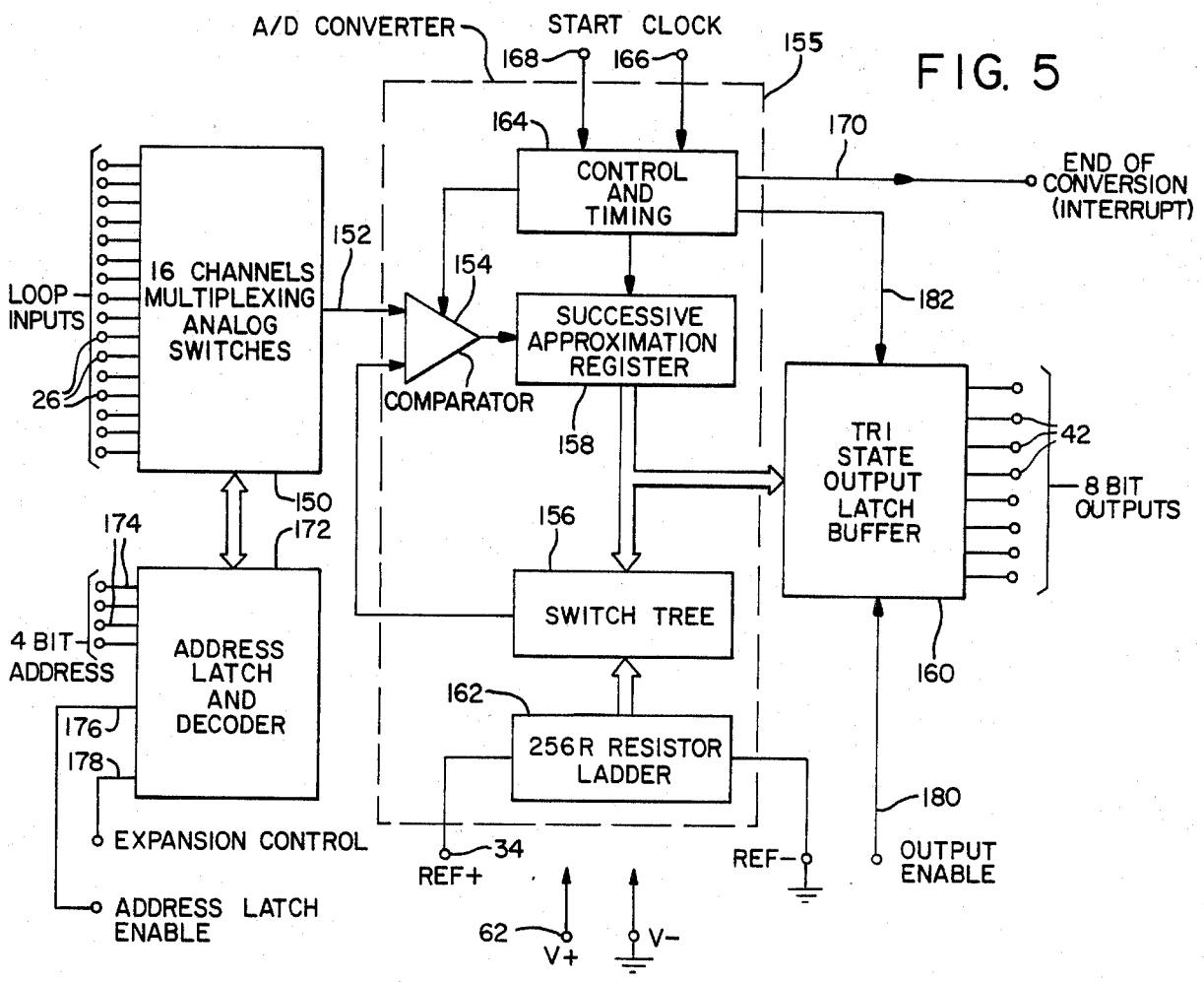
FIG. 5 is a schematic diagram of the electrical circuit of the analog to digital converter and multiplexer circuit employed in the security systems of FIGS. 1 through 4.

A common loop output 26 for all the detectors of the first loop 10 is connected from the common connection terminal of the current sources 18, 20, 22 and 24 to the first analog input, $V_{in}$, of an analog to digital converter and multiplexer circuit 28. The analog to digital converter and multiplexer circuit 28 may be a type ADC 0816 analog to digital converter sold by National Semiconductor Corporation, whose electrical circuit is shown in FIG. 5. A termination resistance 30 of a predetermined resistance, such as 300 ohms, is connected between the common loop output 26 and ground. Thus, when the detectors are not actuated, the total current flowing in termination resistor 30 is $I_{k+1}$ or 8 milliamps current source 24 which produces a predetermined voltage drop of 2.4 volts across termination resistor as the analog detection voltage signal on output 26 applied to the analog to digital converter. However, when any of the detector switches 12, 14 or 16 is closed by actuation of the detector, additional current $I_1$, $I_2$ or $I_k$ of 1, 2 or 4 milliamps, respectively, provided by the current sources 18, 20 and 22, also flows through the termination resistance 30 and added to the 8 milliamps of $I_{k+1}$ to increase the voltage drop across such resistance to 2.7 volts, 3.0 volts or 3.6 volts, respectively. This results in an increase in the amplitude of the analog detection voltage signal produced at the loop output 26 and applied to the first input $V_{in}$ of the analog to digital converter circuit 28. Thus, the amplitude of the analog detection signal produced at loop output 26 is a different predetermined voltage value for each actuated detector switch 12, 14 and 16, thereby identifying such actuated switch.

Each of the detectors 12, 14 and 16 is connected in common to a source of positive D.C. reference voltage, $V_{ref}$, at terminal 32, such reference voltage also being connected to the reference voltage input 34 of the analog to digital converter 28. As a result, both the detector loop and the analog to digital converter circuit have the same reference voltage so that any change in such reference voltage due to thermal drift or aging of circuit components does not affect the accuracy of the security system.

A second sensor loop 36, a third sensor loop 38 and additional sensor loops up to a sixteenth sensor loop 40, all identical to the first loop 10, have their common loop outputs 26 connected to different inputs of the analog to digital converter 28 and their voltage reference terminals connected by lead 41 to D.C. reference voltage source 32. In addition, each of these other sensor loops 36, 38 and 40 has its loop output 26 connected to ground through a separate termination resistor 30 in a similar manner to a first loop 10. Thus, all the other sensor loops are connected the same and operate in a similar manner as the first loop 10.

The analog to digital converter and multiplexer circuit 28 includes a multiplexer switching circuit which selectively switches between the plurality of inputs connected to the common loop outputs 26 of the sensor loops. The analog detector signals at out- puts 26 are thereby sequentially converted to binary coded digital detector signals at the outputs 42 of the analog to digital con- verter. The digital detector signals may be 8 bit binary coded signals transmitted from eight outputs 42 of the converter circuit 28 to the inputs of a microprocessor computer 44 or other digital data processing circuit.

The microprocessor 44 may be a Series 8048 microprocessor digital computer made by Intel Corporation. Such microprocessor includes an 8 bit central processing unit connected to a clock pulse generator, a program memory, and a data memory. The microprocessor determines when a detector has been actuated and the identity of the actuated detector, and produces a plurality of output signals including remote outputs 46 which may be connected to a police station, fire station, or other remote utilization devices, and a plurality of local outputs 48 which may be connected to various types of alarms including indicator lamps 50 and bells 52.

A local keyboard 54 may be connected at input 56 to the microprocessor in order to change the computer program of such microprocessor by manually depressing the keys of such keyboard in a conventional fashion. Also, remote changing of the computer program may be accomplished by a phone line interconnect 58 connected between a central station and an input/output terminal 60 of the microprocessor. The microprocessor is connected at its V+ input to a positive D.C. voltage source 62 and such voltage source is also connected to the V+ input of the analog to digital converter. The Vinputs of the micro- processor 44 and the analog to digital converter circuit 28 are both connected to ground, and the negative reference input, REF-, of the analog to digital converter is also connected to ground.

Figure 2:
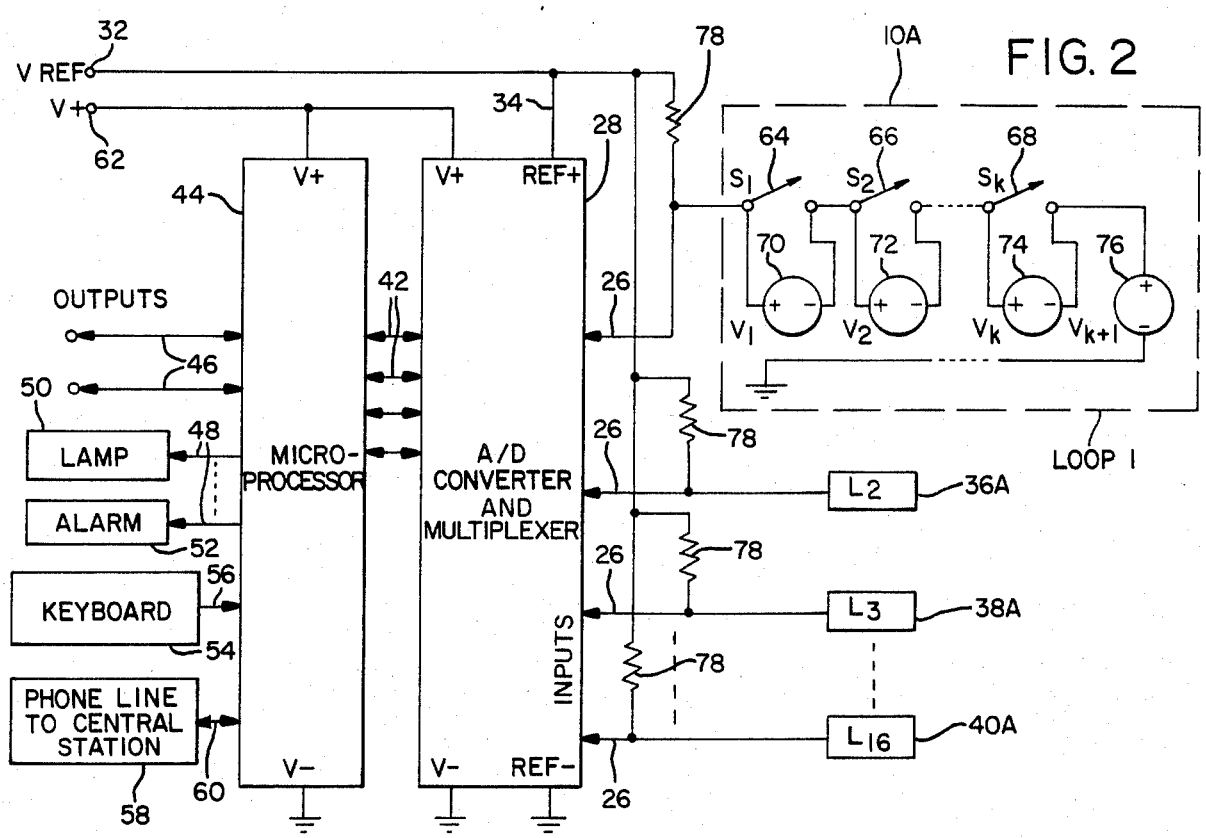
FIG. 2 is a schematic diagram of an eletrical circuit of a second embodiment of the security system of the present invention employing sensor loops having detectors connected in series sensor circuits with constant voltage sources of different voltage values as the identification means associated with each detector to identify the actuated detector.

Another embodiment of the security system of the present invention is shown in FIG. 2, and is similar to FIG. 1 so that the same reference numerals have been used for like parts. The security system of FIG. 2 includes a modified first sensor loop 10A having three detectors 64, 66 and 68 connected in series sensor circuits, each sensor circuit including one of a plurality of constant D.C. voltage sources 70, 72 or 74 of different voltage values. Such constant voltage sources may be Zener diodes. Thus, the first detector 64 designated as a normally open detector switch $S_1$ is connected in parallel with a first constant voltage source 70 producing a first voltage $V_1$ of a predetermined constant value. The second detector 66 shown as a normally open detector switch $S_2$ is connected in parallel with a second constant voltage source 72 which produces a constant D.C. voltage $V_2$ of greater value than voltage $V_1$. The third detector 68 designated as a normally open detector switch $S_k$ is connected in parallel with a third constant voltage source 74 producing a voltage $V_k$ which is greater than voltage $V_1$ or voltage $V_2$. The three constant voltage sources 72, 73 and 74 are connected in series with a fourth constant D.C. voltage source 76 having a voltage $V_{k+1}$ greater than voltage $V_k$, between the reference voltage terminal 32 and ground. The three detector switches 64, 66 and 68 are connected in series to the common loop output 26. A termination resistor 78 is connected between such loop output and the D.C. voltage reference terminal 32.

The detector switches 64, 66 and 68 are normally open so that the analog detector voltage produced at the loop output terminal 26 and applied to the first input, $V_{in}$, of the analog to digital converter and multiplexer circuit 28 is a total voltage, $V_t$, equal to $V_t = V_1 + V_2 + V_k + V_{k+1}$. If any of the detector switches 64, 66 and 68 are operated, such switches are closed to short circuit its associated constant voltage source. This reduces the amplitude of the total analog detector voltage on loop output 26. The amount of the voltage reduction and the amplitude of the resulting analog detection signal at loop output 26 identifies the detector switch which is actuated. For example, if constant voltage sources 70, 72, 74 and 76 are equal to 0.25 volts, 0.5 volts, 1 volt, and 2 volts, respectively, the analog detector voltage at loop output 26 when detector switches 64, 66 and 68 are all unactivated and open, is +3.75 volts. However, when detector switch 64 is closed and detector switches 66 and 68 are open, the total analog detector voltage at loop output 26 is +3.5 volts. Similarly, when detector switch 66 is actuated and closed and detector switches 64 and 68 are unactuated and open, the total analog detector voltage at loop output 26 is +3.25 volts. However, when detection switch 68 is actuated and closed while detection switches 64 and 66 are unactuated or open, the total analog detection voltage at loop output 26 is +2.75 volts. Thus, the amplitude of the analog detector voltage on the loop output 26 indicates which of the three detection switches 64 and 68 is actuated, and thereby identifies such actuated detectors.

The second sensor loop 36A, the third sensor loop 38A and the sixteenth sensor loop 40A are identical in circuitry and connection to the first loop 10A, and therefore, will not be described further.

Figure 3:
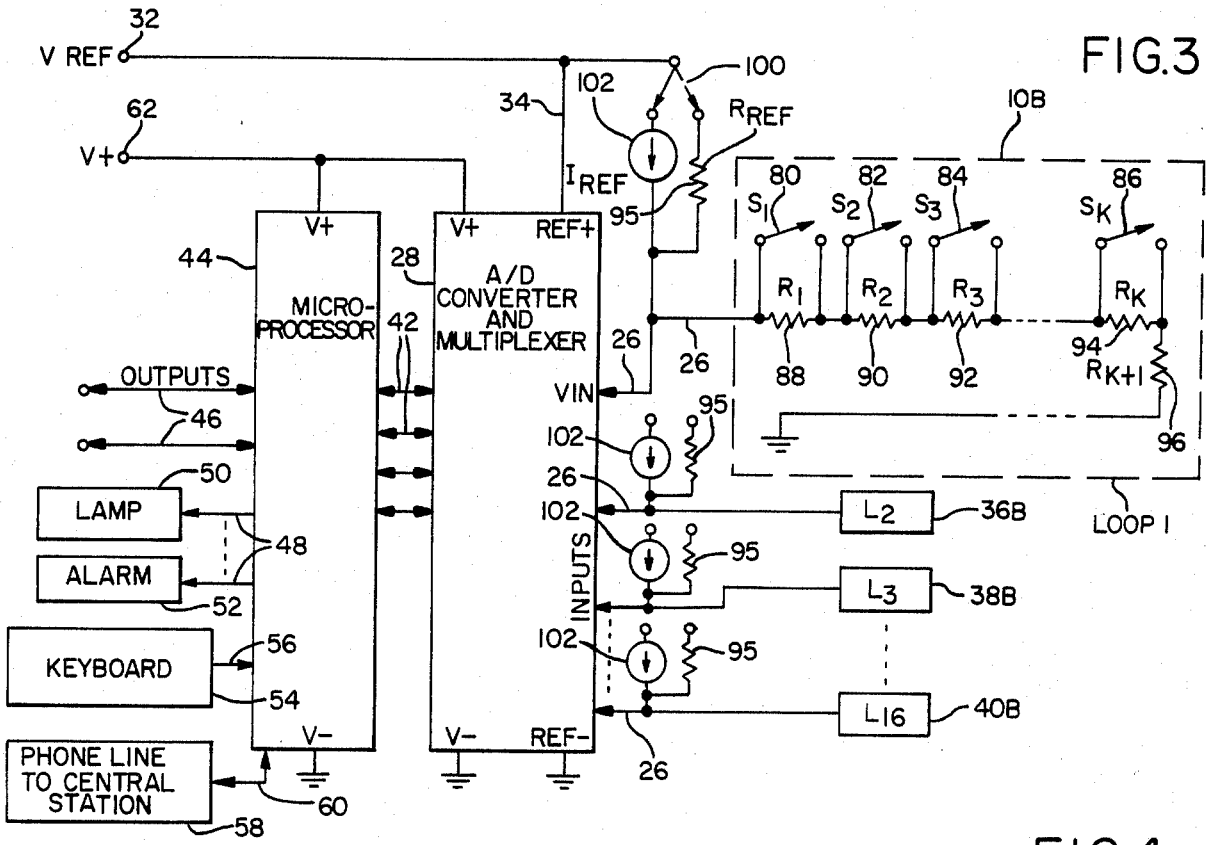
FIG. 3 is a schematic diagram of the electrical circuit of a third embodiment of the security system of the present invention including sensor loops having detectors connected in series sensor circuits including detector identification resistors of different values connected in parallel with the detectors.

A third embodiment of the security system of the present invention is shown in FIG. 3 and is similar to those of FIGS. 1 and 2 so that the same reference numerals have been employed to indicate like parts. A modified first sensor loop 10B including four detectors shown as normally open switches 80, 82, 84 and 86 connected in series sensor circuits. The common loop output 26 is connected from detector switch 80 to the first analog input of the converter 28. The sensor circuits include detector identification resistors 88, 90, 92 and 94 of different resistance values which are connected in parallel with their associated detector switches 80, 82, 84 and 86, respectively. Thus, the first resistor 88 is connected in parallel with the first detector switch 80, and is of a predetermined resistance value, $R_1$, half the resistance R of a reference resistor 95 connected between output 26 and the reference voltage terminal 32 in the dashed line position of a selector switch 100. The second resistor 90 is connected in parallel with the second detector switch 82 and is of a resistance value, $R_2$, approximately half that of resistor $R_1$. The third resistor 92 is connected in parallel with the third detector switch 84 and is of a resistance value, $R_3$, equal to half that of resistor $R_2$. The fourth resistor 94 is connected in parallel with the fourth detector switch 86 and is of a resistance value, $R_k$, equal to half that of resistor $R_3$. A termination resistor 96 having a resistance, $R_{k+1}$, of half that of the fourth resistor $R_k$ is connected in series with resistors 88, 90, 92 and 94 between the fourth resistor 94 and ground. When all of the detector switches 80, 90, 92 and 94 are un- actuated and in an open circuit condition, the total loop resistance, $R_t$, is given by $R_t=R_1+R_2+R_3+R_k+R_{k+1}$. When any of such detector switches are actuated to close such switch it shorts the associated identification resistor to reduce the total loop resistance $R_t$. As a result, the amplitude of the analog detector voltage across such total loop resistance and applied to the loop output 26 also reduces by corresponding amount which is different for each switch to identify the actuated switch.

The reference resistor 95 may be connected by a selector switch 100 in series with the loop resistors 88, 90, 92, 94 and 96 between the D.C. reference voltage source 32 and ground to form a voltage divider with the loop resistors. As a result of the voltage divider, that portion of the reference voltage which is developed across the total resistance of the loop 10B is applied as the analog detection voltage at loop output 26 to the first input $V_{in}$ of the analog to digital converter and multiplexer 28. As the detector switches 80, 82, 84 and 86 are closed, they short-circuit a portion of the voltage divider resistance, thereby reducing the amount of loop resistance and reducing the amplitude of the analog detection voltage produced at the loop output 26. Since resistors 88, 90, 92 and 94 are of different values, when each of the associated detector switches 80, 82, 84 and 86 are closed at different times they reduce the amplitude of the analog detection voltage by different amounts, and the resulting amplitude of such detection voltage identifies which of the detector switches has been closed. Thus, the resistors 88, 90, 92 and 94 serve as identification means for identifying which of their associated detectors 80, 82, 84 and 86, respectively, has been actuated.

In an alternative connection the selector switch 100 may be moved to the solid line position connecting a constant current source 102 between the voltage reference source 32 and the common terminal of the first resistor 88 and the output 26 of the first detector loop 10B. In this case, the constant current source 102 which may be a field transistor circuit similar to those used for the constant current sources 18, 20, 22 and 24 of FIG. 1, supplies a constant reference current which flows through the total resistance of the loop. As a result, when the total resistance of the loop is reduced by closing one of the detector switches 80, 82, 84 and 88, the voltage drop across such total loop resistance also changes to lower the amplitude of the analog detection signal at loop output 26 to a value that identifies which of the detector switches is closed. The second sensor loop 36B, the third sensor loop 38B and the sixteenth sensor loop 40B are of the same circuitry and same operation as the first loop 10B. The loop outputs 26 of the loops 36B, 38B and 40B are connected to separate constant current sources 102 and to separate reference resistors 95 by switch 100 in the same manner as the first loop.

Figure 4:
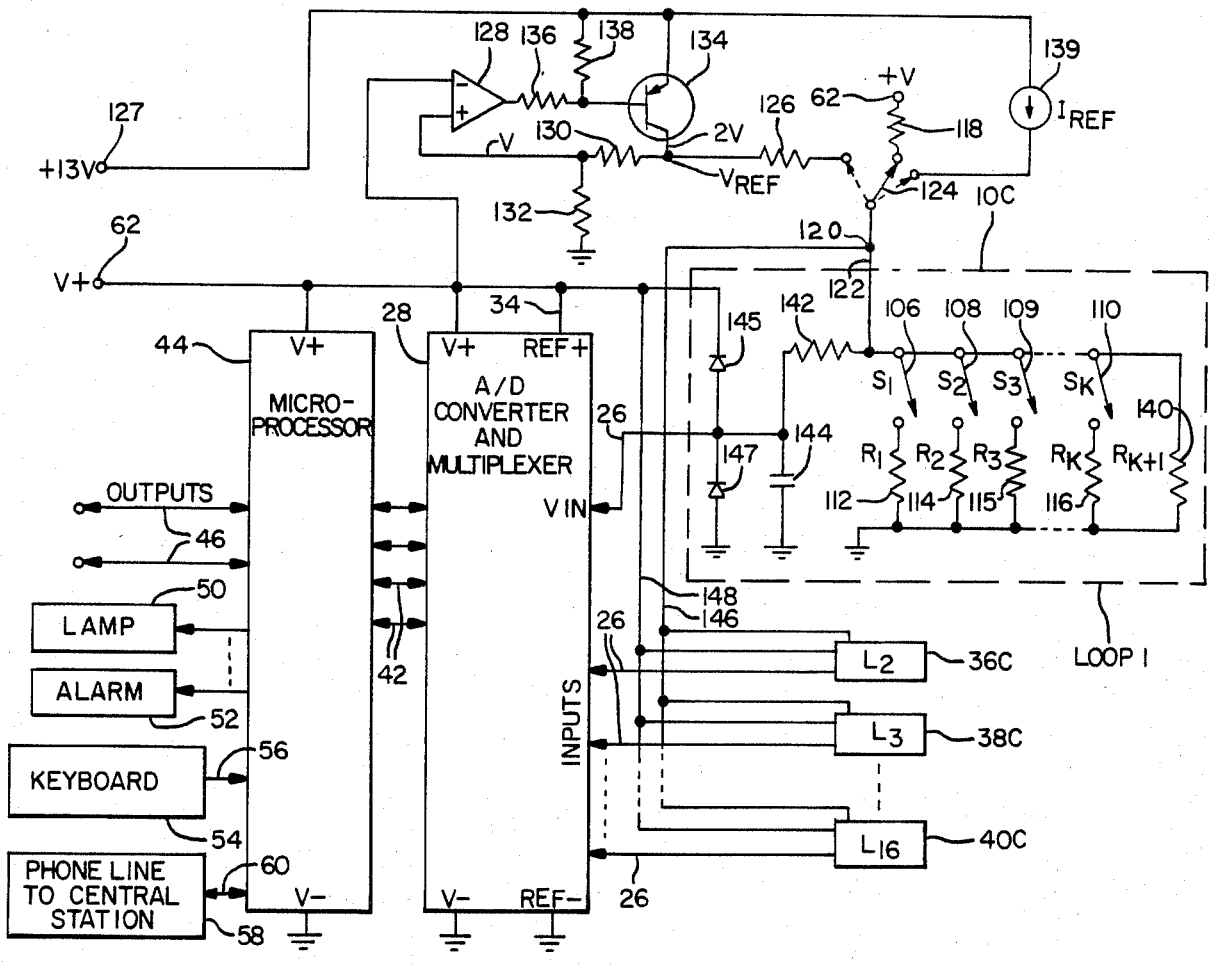
FIG. 4 is a schematic diagram of an electrical circuit of a fourth embodiment of the security system of the present invention including sensor loops having detectors connected in parallel sensor circuits including detector identification resistors of different value connected in series with each detector.

A fourth embodiment of the security system of the present invention is shown in FIG. 4 and it is similar to the embodiments shown in FIGS. 1, 2 and 3, so that the same reference numerals have been employed to designate like parts. The modified first sensor loop 10C of FIG. 4 having its common loop output 26 connected to the first input $V_{in}$ of the analog to digital converter and multiplexer circuit 28, includes at least four detectors 106, 108, 109 and 110 connected in parallel sensor circuits. However, unlike the embodiment of FIG. 1, the ident- ification means in these parallel sensor circuits are not constant current sources, but instead are four resistors 112, 114, 115 and 116 of different resistance values. Thus, the first detector 106 which may be a normally open detector switch $S_1$ is connected in series with a first identification resistor 112 having a resistance $R_1$ equal to that of a reference resistor 118 or 126 connected to a voltage reference point 120 at input terminal 122 of the sensor loop. A selector switch 124 in its solid line position connects the voltage reference point 120 through the reference resistor 118 to a V+ source 62 of positive D.C. reference voltage of +5 volts. However, in the left dashed line position of the selector switch 124, point 120 is connected through another reference resistor 126 to a greater reference voltage produced at point 120 equal to 2 times V+ or +10 volts which is twice the, V+, voltage of +5 volts at terminal 64 as indicated by "2 V" at such switch position.

The doubling of the V+ voltage is achieved by means of a comparator amplifier 128 having its negative terminal connected to the V+ voltage source 62 and having its positive terminal connected to the junction of a pair of voltage divider resistors 130 and 132, each of 10 kilohms resistance. The voltage divider resistors are connected in series between the collector of an inverter amplifier transistor 134 to ground. The base of the transistor 134 is connected to the output of amplifier 128 through a coupling resistor 136 of 10 kilohms and the emitter of such transistor is connected to a voltage source 127 of +13 volts. A bias resistor 138 of 1 kilohm resistance is connected between the base and the emitter of transistor 134 to bias such transistor normally non-conducting. Transistor 134 may be a PNP type transistor such as a 2N2907 transistor. The +13 volts applied to the emitter of transistor 134 causes current to flow through such transistor and voltage divider resistors 130, 132 to ground. When the voltage across resistor 132 reaches +V and equal to the voltage +V on the negative input of comparator amplifier 128, the output voltage of such comparator amplifier increases to +13 volts which reduces the emitter to collector current of transistor 134 to a value which maintains a V+ voltage on the positive input of comparator 128. The current flowing through transistor 134 produces a voltage drop across the voltage divider resistors 130 and 132 of +2 V in order to maintain a +V voltage on the positive input of the comparator amplifier 128. In this manner, the +2 V reference voltage of +10 volts is provided on the collector of transistor 134 and at reference point 120 for the sensor loops when switch 124 is in the left dashed line position.

A constant source 139 may be connected in the right dashed line position of switch 124 between the +13 volts source 127 and the reference point 120. In this way, a constant reference current, $I_{ref}$, is supplied to the inputs 122 of each of the sensor loops.

The second identification resistor 114 is connected in series with the second detector switch 108 and has a resistance value twice that of the first identification resistor 112. Similarly, a third resistor 115 is connected in series with the third detector switch 109 and may have a value equal to twice that of the second resistor 114. A fourth detector switch 110 and a fourth identification resistor 116 are connected in series and have been labeled $S_k$ and $R_k$ to indicate that additional detector switches and resistors may be connected between the third and fourth sensor circuits. A termination resistor 140 having a resistance value twice that of the fourth resistor 116 is connected in parallel with all of the detector switches 106, 108, 109 and 110, and their associated identification resistors. Thus, when all of the detector switches 106, 108, 109 and 110 are unactuated and in the open po- sition, the analog detection voltage produced by the first loop 10C is equal to the current flowing through the termination resistor 140 times the resistance of such resistor. Such detection voltage being produced at terminal 122 and transmitted through a current limiting resistor 142 to the common loop output 26.

The current limiting resistor 142 may have a value of 10 kilohms and together with a shunt capacitor 144 of 0.1 microfarad connected from the loop output 26 to ground forms a bypass filter which bypasses noise signals to ground and presents such noise signals from being fed into the analog to digital converter and multiplexer 28. A pair of over-voltage protection diodes 145 and 147 are connected respectively from the common loop 26 to the positive D.C. reference voltage at terminal 34 and to ground, respectively. Thus, the anode of diode 145 and the cathode of diode 147 are connected in common to the loop output 26, while the cathode of diode 145 is connected to the reference voltage terminal 34 and the anode of diode 147 is grounded. These diodes may be PN junction semiconductor diodes of the 1N4148 type.

It should be noted that the reference voltage for the sensor loops produced at reference point 120 is the same or twice the reference voltage applied to the reference input 34 of the analog to digital converter and multiplexer 28. Since the reference voltage used for the converter circuit is a fixed multiple of that used for the sensor loops, the present security system is more accurate in detection of the sensor loops because the analog detection voltage is independent of thermal drift or other changes in the reference voltage. This eliminates the need for dual reference voltage tracking. Also, the embodiment of FIG. 4 has the advantage of low cost since the identification means for the detector switches are relatively inexpensive resistors. For example, the first identification resistor 112 can be 20 kilohms or twice the 10 kilohms of the reference resistor 118. The second resistor 114 may be 40 kilohms. The third resistor 115 may be 80 kilohms, the fourth resistor 116 may be 160 kilohms and the termination resistor 140 may be 320 kilohms. All of the resistors of the circuit of FIG. 4 may have a resistance of 5% tolerance accuracy except for the reference resistor 118 and the first resistor 112 having a 0.5% tolerance, the second and third resistors 114 and 115 having an accuracy of 1.0% and the fourth resistance 116 which may have an accuracy of 2.0% of their rated value.

The remaining sensor loops including the second sensor loop 36C, the third sensor loop 38C and the sixteenth sensor loop 40C are of similar circuitry and operation to the above-described first sensor loop 10C. Each of these sensor loops includes the current limiting resistor 142 and the filter capacitor 144 connected in common to loop output 26. Also each of such sensor loop includes the pair of protection diodes 145 and 147 and the cathode of diode 145 is connected by line 148 to V+ at 62.

The following mathematical proof shows how the sensor loop resistors 112, 114, 115 and 116 of FIG. 4 serve as identification means to identify to the A/D converter 28 which of the detector switches 106, 108, 109 and 110 has been operated.

The characteristics of the A/D converter are described by the equation:

$$N=2^{Z*}(Vin/Vref) \qquad \text{Equation 1}$$

where

N=digital number at output of A/D converter,

Z=number of bits in digital output of A/D converter,

Vin=voltage passed by loops at output 26 to the A/D converter, and Vref=reference voltage at input 34 of the A/D converter.

The characteristics of the loop are described by the equation:

$$Vin=Vref*(Rloop/(Rref+Rloop)) \qquad \text{Equation 2}$$

where

Rloop=the parallel combination of all sensor resistors 112, 114, 115, 116 and 140, and Rref=the resistor 118.

Combining the two Equations 1 and 2 yields:

$$N=2^{Z*}(Rloop/(Rref+Rloop)) \qquad \text{Equation 3}$$

Notice that in Equation 3 the A/D converter output N is independent of Vref.

Next note that:

$$Rloop=1/(S_1/R_1+S_2/R_2+\ldots+S_k/R_k+1/R_{k+1}) \qquad \text{Equation 4}$$

where $S_1=1$ if the first detector switch 106 is closed and $S_1=0$ if such detector switch is open, etc., and k=number of detectors.

To find the number of detectors that can be uniquely sensed on a single sensor loop:

$$\text{let } R_k=(2^k)*Rref \qquad \text{Equation 5}$$

This is done so that $dN/dRref=0$ and maximum detector sensitivity is achieved.

let Ra=Rloop with $S_1$ to $S_k$ closed Equation 6, and let Rb=Rloop with $S_1$ to S(k−1) closed and $S_k$ open Equation 7

Because of the nonlinear operation of the ratiometric configuration of FIG. 4 the change from condition Ra to Rb produces the smallest voltage change in Vin. Then:

$$N=N(S_k \text{ open})-N(S_k \text{ closed})=2^z/(1+Rref/Rb)-2^z/(1+Rred/Ra) \quad \text{Equation 8}$$

noting that in the limit as $k=(\text{infinity})-, Rref=Ra=Rb=R$, and by combining Equations 3 to 8 yields:

$$N=(2^z)*(Ra-Rb)/(4*R) \quad \text{Equation 9}$$

And $$Ra=1/(1/R_1+1/R_2+\ldots 1/R_k+1/R_{k+1}) \quad \text{Equation 10}$$

$$Rb=1/(1/R_1+1/R_2+\ldots 0/R_k+1/R_{k+1}) \quad \text{Equation 11}$$

Thus, by combining Equations 9 to 11 we get:

$$Ra-Rb=(1/R_k)/(1/R^2)=R/(2^k) \quad \text{Equation 12}$$

and combining Equations 9 and 12 yields:

$$N=((2^z)/(4*R)*(R/(2^k)=(2^{z-2})/(2^k) \quad \text{Equation 13}$$

The smallest resolution an ideal A/D converter has is N=1,
and the maximum number of detectors that can be sensed in a single loop is:

$$K=Z-2 \quad \text{Equation 14}$$

Thus, for an 8 bit A/D converter the maximum number of K of detectors is $K=8-2$ or 6. Because of component tolerances, most applications must use fewer sensors.

In the embodiment of FIG. 4, four sensors are used per loop with the following component ratios:

Rref=R (0.5% tolerance)
R1=2*R (0.5% tolerance)
R2=4*R (1.% tolerance)
R3=8*R (1.% tolerance)
R4=16*R (2.% tolerance)
R5=32*R (5.% tolerance)

Using these values with tolerances in Equations 10 and 11.

Rref=0.995 to 1.005R
Ra=1.023 to 1.042R
Rb=1.094 to 1.113R.

Also, allowing for 200 feet of #24 wirre at 25 ohms per 1000 feet.

Na=129.11 to 131.55 counts
Nb=133.42 to 135.73 counts

Thus:

Nb−Na+1.87 counts worst case and the A/D converter decision point is:

Nthresh=132.5 + or − 1 count.

This is well within the specifications for currently available A/D converters.

One suitable analog to digital converter and multiplexer circuit 28 is shown in FIG. 5. The sensor loop outputs 26 are connected to the sixteen analog inputs of a 16 channel multiplexer switching circuit 150 whose single output 152 is connected to the input of a high impedance chopper stablized comparator circuit 154 forming part of an analog to digital converter 155. The other input of the comparator is connected to a D.C. reference voltage at the output of a switch tree circuit 156 within the analog to digital converter. The switch tree applies different D.C. reference voltages to the lower input of the comparator and switches such reference voltage to different values in response to the output signal of a successive approximation register 158 having its input connected to the output of the comparator. Thus, each analog detector signal input 26 is compared by comparator 154 with different D.C. reference voltages which are changed by the successive approximation register 158 in order to determine the voltage value of the amplitude of such analog detection signal and to convert it into a binary coded digital detection signal at the output of the register. The output of the register 158 is applied to a tri-state output latch buffer memory circuit 160. The buffer circuit has eight output terminals 42 which supply an 8 bit binary coded digital detection output signal to the microprocessor 44. The switch tree is connected to a resistor ladder voltage divider 162 which produces the different D.C. reference voltages for the comparator. The ladder voltage divider 162 has one terminal connected to a positive D.C. reference voltage source 34 and its other terminal grounded as the negative reference voltage. Thus, the switch tree selects one D.C. reference voltage from the resistance voltage ladder 162 and applies it to the comparator 154 in response to switching control signals received by the switch tree from the successive approximation register 158.

A control and timing circuit 164 supplies control and timing signals to the comparator 154 and the successive approximation register 158 in response to the receipt of clock pulse signals at clock input 166 after receiving a start pulse signal at input 168 from the microprocessor. The control and timing circuit 164 produces a stop or end of conversion output pulse at end of the analog to digital conversion of the analog detection signal on output terminal 170 which is connected to the microprocessor. The multiplexer 150 is connected to an address latch and decoder circuit 172 having a 4 bit address input signal applied to four address terminals 174 connected to the output of the microprocessor as well as an address latch enable input 176 and an expansion control input 178 connected to such microprocessor. Thus, the microprocessor controls the switching of the multiplexer by the address latch and decoder 172, and also, controls the operation of the analog to digital converter by the control and timing circuit 164. In addition, the output latch and buffer 160 has an enabling input 180 connected to the microprocessor and is also connected at input 182 to the control and timing circuit 164. The analog to digital converter and multiplexer unit 28 of FIG. 5 may be of the CMOS semiconductor integrated circuit type ADC 0816 made by National Semiconductor Corporation.

It will be obvious to those having ordinary skill in the art that many changes may be made in the above-described preferred embodiments of the present invention. Therefore, the scope of the present invention should only be determinned by the following claims.

I claim:

1. A security system having detector sensing and identification by analog signal amplitude, comprising:

sensor loop means including a plurality of sensor loops for generating detector signals when detectors in said loops are actuated, each sensor loop including a plurality of detectors which are connected together and are coupled to a common loop output for applying an analog detector signal to said loop output when any of said detectors are actuated;

identification means provided in each sensor loop with a separate detector identification means connected to each detector, for producing analog detection signals of different D.C. amplitudes for the detectors of each loop, each detection signal amplitude also being different than the sum of any combination of the other detection signal amplitudes produced by the other detectors of the loop; and analog to digital converter means having a plurality of loop inputs each connected to the common loop output of a different loop, for applying analog detection signals of D.C. amplitudes to the inputs of the converter means and for converting said analog detection signal to a digital detection signal which identifies the actuated detector;

said converter means including a multiplexer means for selectively switching said loop inputs to the common input of a comparator circuit in said analog to digital converter means.

2. A security system in accordance with claim 1 which also includes:

digital data processor means connected to said converter means for controlling said converter and said multiplexer and for processing the digital detector signals produced by said converter means to determine which detector produced a detector signal and to generate a corresponding output signal; and alarm means connected to the input of said data processor means for indicating when said detectors are actuated.

3. A security system in accordance with claim 1 in which the analog to digital converter circuit includes a successive approximation register.

4. A security system in accordance with claim 1 in which each sensor loop has a protection means including a first diode connected between the common loop output and a reference voltage source, a second diode connected between said common loop output and ground, and a current limiting resistor connected between the common terminal of the diodes and the detectors of the loop, and filter means including a capacitor connected between said current limiting resistor and ground for filtering noise from the analog detection signal.

5. A security system in accordance with claim 2 in which the detectors of each loop are connected in parallel sensor circuits.

6. A security system in accordance with claim 5 in which the detectors are switches and the identification means are constant current sources of different current values each connected to a different one of the switches to form the sensor circuits, said sensor circuits being connected through a common reference resistor to ground with the common loop output being connected to the ungrounded terminal of said reference resistor.

7. A security system in accordance with claim 5 in which the detectors are switches and the identification means are resistors of different resistance values each connected to a different one of the switches to form the sensor circuits.

8. A security system in accordance with claim 7 in which the sensor circuits are connected between the a loop input and ground, said loop input being connected to a constant current source.

9. A security system in accordance with claim 7 in which the sensor circuits are connected to the common loop output and said common loop output is connected through a reference resistance to a reference voltage which is a fixed multiple of the reference voltage applied to the analog to digital converter means.

10. A security system in accordance with claim 2 in which the detectors of each loop are connected in series sensor circuits.

11. A security system in accordance with claim 10 in which the detectors are switches and the identification means are constant voltage drop devices of different voltage drop values each connected across a different one of said switches to form the sensor circuits, said sensor circuits being connected in series with a reference resistor between a reference voltage source and ground, and the common loop output being connected to the terminal of said reference resistor remote from said reference voltage source.

12. A security system in accordance with claim 10 in which the detectors are switches and the identification means are resistors of different resistance values each connected across a different one of said switches to form the sensor circuits, said sensor circuits being connected in series with a constant current source between a reference voltage source and ground, and the common loop output being connected to the terminal of the constant current source remote from said voltage reference source.

13. A security system having detector sensing and identification by analog signal amplitude, comprising:

sensor loop means including a plurality of sensor loops for generating detector signals when detectors in said loops are actuated, each sensor loop including a plurality of detectors which are connected in parallel sensor circuits and are coupled to a common loop output for applying an analog detector signal to said loop output when any of said detectors are actuated;

identification means provided in each sensor loop with a separate identification means connected to each detector, for producing analog detector signals of different D.C. amplitudes for the detectors of each loop, each detection signal amplitude also being different than the sum of any combination of the other detection signal amplitudes produced by the other detectors of the loop;

signal processor means for processing the detector signals to determine which detector produced a given detector signal and to generator a corresponding output signal; and alarm means connected to the output of said signal processor means for indicating when said detectors are actuated.

14. A security system in accordance with claim 13 in which the detectors are switches and the identification means are constant current sources of different current values each connected to a different one of the switches to form the sensor circuits, said sensor circuits being connected through a common reference resistor to ground with the common loop output being connected to the ungrounded terminal of said reference resistor.

15. A security system in accordance with claim 13 in which the detectors are switches and the identification means are resistors of different resistance values each connected to a different one of the switches to form the sensor circuits.

16. A security system in accordance with claim 15 in which the sensor circuits are connected between a loop input and ground, said loop input being connected to a constant current source.

17. A security system in accordance with claim 15 in which the sensor circuits are connected to the common loop output and said common loop output is connected through a reference resistance to a reference voltage which is a fixed multiple of the reference voltage applied to an analog to digital converter means whose input is connected through a multiplexer switching means to a plurality of analog inputs connected to the common loop outputs of a plurality of different sensor loops.

* * * * *

UNITED STATES PATENT AND TRADEMARK OFFICE

CERTIFICATE OF CORRECTION

PATENT NO. : 4,524,349

DATED : June 18, 1985

INVENTOR(S) : David R. Hyatt

It is certified that error appears in the above-identified patent and that said Letters Patent is hereby corrected as shown below:

Column 11, line 13 (Equation 8):
(1+Rred/Ra) should be (1+Rref/Ra);

Column 13, line 39, "input" should be --output--.

Signed and Sealed this

*First* Day of *April 1986*

[SEAL]

*Attest:*

DONALD J. QUIGG

*Attesting Officer*

*Commissioner of Patents and Trademarks*